US008663460B2

(12) United States Patent
Gallup

(10) Patent No.: US 8,663,460 B2
(45) **Date of Patent: *Mar. 4, 2014**

(54) PROCESS, METHOD, AND SYSTEM FOR REMOVING HEAVY METALS FROM FLUIDS

(75) Inventor: Darrell Lynn Gallup, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 558 days.

This patent is subject to a terminal disclaimer.

(21) Appl. No.: 12/883,578

(22) Filed: Sep. 16, 2010

(65) Prior Publication Data

US 2012/0067785 A1 Mar. 22, 2012

(51) Int. Cl.

| | |
|---|---|
| ***C10G 17/00*** | (2006.01) |
| ***C10G 17/07*** | (2006.01) |
| *C10G 17/02* | (2006.01) |
| *C10G 17/04* | (2006.01) |
| *C10G 21/00* | (2006.01) |
| *C10G 21/06* | (2006.01) |
| *C10G 21/18* | (2006.01) |
| *C10G 29/12* | (2006.01) |
| *C10G 29/26* | (2006.01) |

(52) U.S. Cl.

CPC ..... *C10G 17/07* (2013.01); *C10G 17/00* (2013.01); *C10G 17/02* (2013.01); *C10G 17/04* (2013.01); *C10G 21/003* (2013.01); *C10G 21/06* (2013.01); *C10G 21/18* (2013.01); *C10G 29/12* (2013.01); *C10G 29/26* (2013.01)

USPC ..... 208/252; 208/251 R

(58) Field of Classification Search

CPC ..... C10G 17/07; C10G 17/00; C10G 17/02; C10G 17/04; C10G 29/12; C10G 29/26

USPC ..... 208/251 R, 252

See application file for complete search history.

(56) References Cited

U.S. PATENT DOCUMENTS

| | | | |
|---|---|---|---|
| 3,873,581 | A | 3/1975 | Fitzpatrick et al. |
| 4,028,236 | A | 6/1977 | Townsend et al. |
| 4,094,098 | A | 6/1978 | Gourley |
| 4,094,777 | A | 6/1978 | Sugier et al. |

(Continued)

OTHER PUBLICATIONS

PCT International Search Report, International App. No. PCT/US2011/050950 date mailed Jun. 14, 2012.

(Continued)

*Primary Examiner* — Prem C Singh
*Assistant Examiner* — Brandi M Doyle
(74) *Attorney, Agent, or Firm* — Alan W. Klaassen

(57) ABSTRACT

Trace element levels of heavy metals such as mercury in crude oil are reduced by contacting the crude oil with an iodine source, generating a water soluble heavy metal complex for subsequent removal from the crude oil. In one embodiment, the iodine source is generated in-situ in an oxidation-reduction reaction, by adding the crude oil to an iodine species having a charge and a reductant or an oxidant depending on the charge of the iodine species. In one embodiment with an iodine species having a positive charge and a reducing reagent, a complexing agent is also added to the crude oil to extract the heavy metal complex into the water phase to form water soluble heavy metal complexes which can be separated from the crude oil, for a treated crude oil having reduced levels of heavy metals.

18 Claims, 1 Drawing Sheet

(56) References Cited

U.S. PATENT DOCUMENTS

Figure 1:
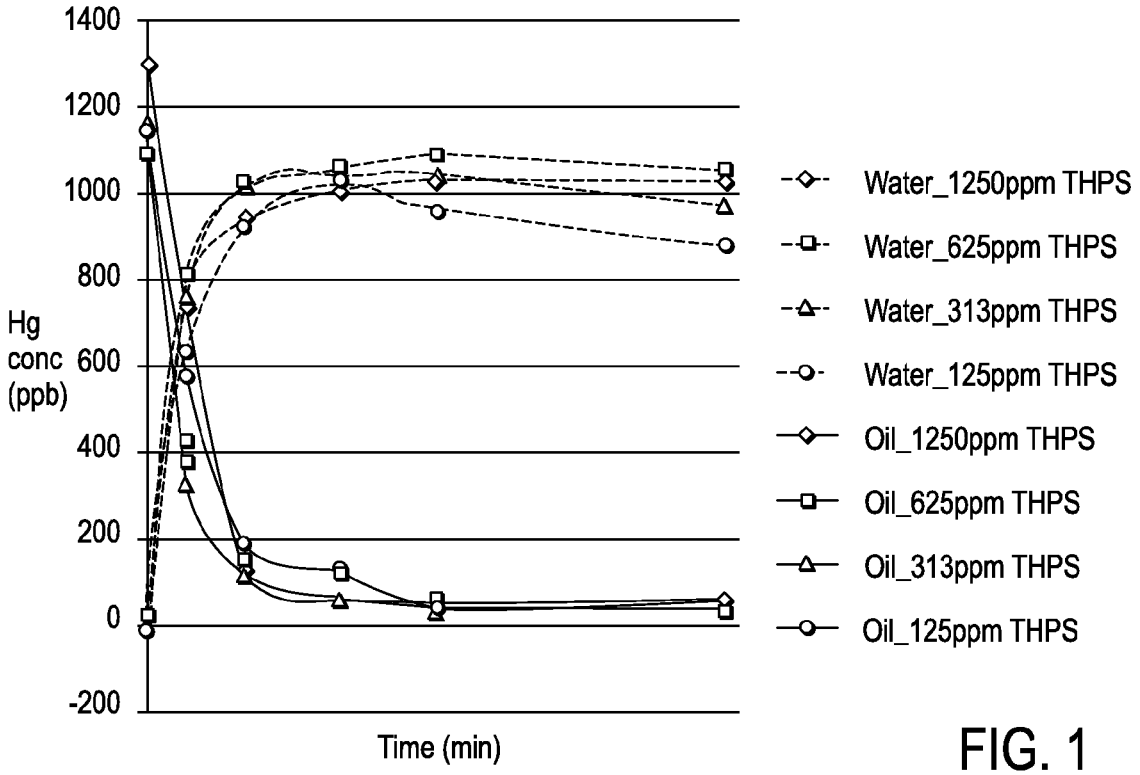
Figure 2:
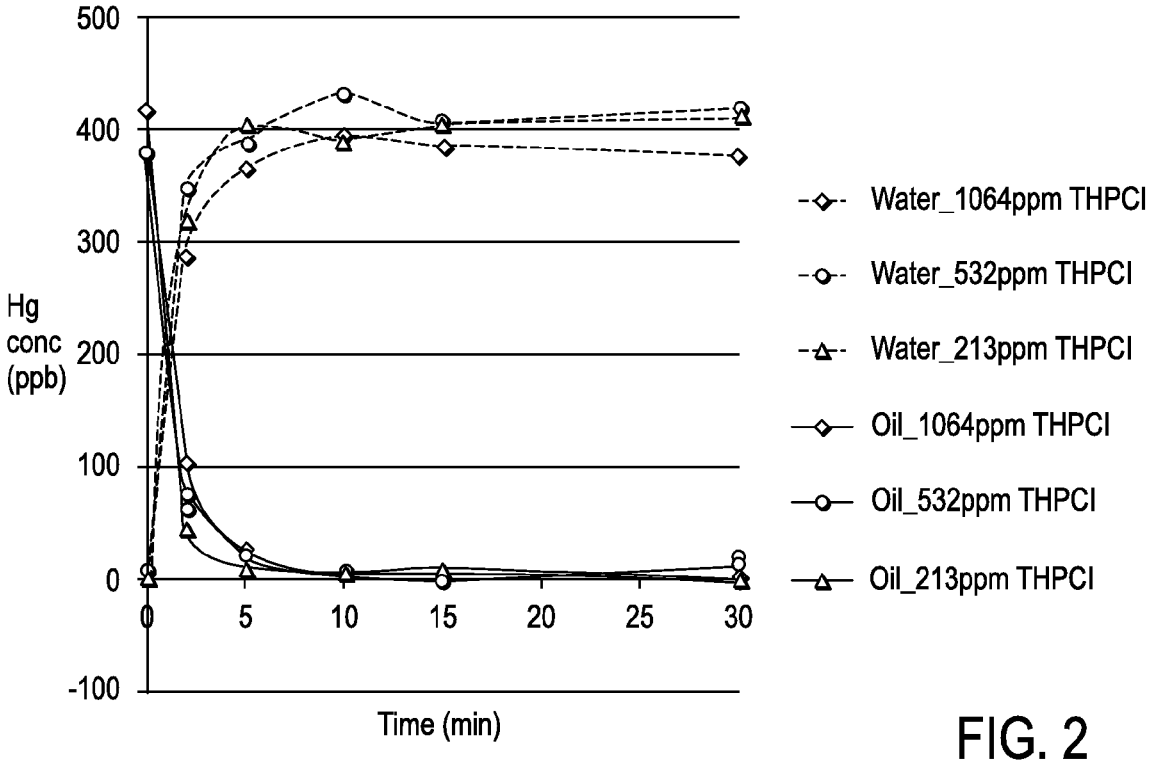

| | | | | |
|---|---|---|---|---|
| 4,108,769 | A | 8/1978 | Krieg et al. | |
| 4,133,755 | A | 1/1979 | Tarao et al. | |
| 4,151,077 | A | 4/1979 | Nogueira et al. | |
| 4,167,481 | A | 9/1979 | Cremers et al. | |
| 4,230,486 | A | 10/1980 | Capuano et al. | |
| 4,336,237 | A | 6/1982 | Kudryk et al. | |
| 4,338,288 | A | 7/1982 | Rollmann | |
| 4,354,942 | A | 10/1982 | Kaczur et al. | |
| 4,474,896 | A | 10/1984 | Chao | |
| 4,578,195 | A | 3/1986 | Moore et al. | |
| 4,619,744 | A | 10/1986 | Horton | |
| 4,678,584 | A | 7/1987 | Elfline | |
| 4,708,853 | A | 11/1987 | Matviya et al. | |
| 4,709,118 | A | 11/1987 | Yan | |
| 4,752,397 | A | 6/1988 | Sood | |
| 4,876,025 | A | 10/1989 | Roydhouse | |
| 4,880,527 | A | 11/1989 | Audeh | |
| 4,915,818 | A * | 4/1990 | Yan | 208/251 R |
| 4,981,577 | A | 1/1991 | Audeh et al. | |
| 5,107,060 | A | 4/1992 | Yan | |
| 5,110,480 | A | 5/1992 | Yan | |
| 5,173,286 | A | 12/1992 | Audeh | |
| 5,202,301 | A * | 4/1993 | McNamara | 502/417 |
| 5,238,488 | A | 8/1993 | Wilhelm | |
| 5,336,835 | A | 8/1994 | McNamara | |
| 5,360,632 | A | 11/1994 | Johnson et al. | |
| 6,197,269 | B1 * | 3/2001 | Jansen et al. | 423/243.01 |
| 6,350,372 | B1 | 2/2002 | Degnan et al. | |
| 6,403,044 | B1 | 6/2002 | Litz et al. | |
| 6,475,451 | B1 | 11/2002 | Leppin et al. | |
| 6,521,131 | B1 | 2/2003 | Hamilton et al. | |
| 6,866,048 | B2 | 3/2005 | Mattox | |
| 7,591,944 | B2 | 9/2009 | Carnell et al. | |
| 7,666,318 | B1 | 2/2010 | Lehtinen et al. | |
| 7,744,763 | B2 | 6/2010 | Cross et al. | |
| 2001/0056127 | A1 * | 12/2001 | Kessler | 514/772.4 |
| 2003/0062316 | A1 | 4/2003 | Mattox et al. | |
| 2003/0226808 | A1 | 12/2003 | Fidoe et al. | |
| 2005/0074392 | A1 * | 4/2005 | Yang et al. | 423/447.3 |
| 2005/0263739 | A1 | 12/2005 | Mattox et al. | |
| 2006/0048646 | A1 | 3/2006 | Olson et al. | |
| 2006/0065604 | A1 | 3/2006 | McKenna et al. | |
| 2006/0201854 | A1 * | 9/2006 | Lott | 208/108 |
| 2008/0283470 | A1 | 11/2008 | Gustafsson et al. | |
| 2009/0057232 | A1 | 3/2009 | Angeles-Boza et al. | |
| 2009/0114247 | A1 | 5/2009 | Brown et al. | |
| 2009/0304563 | A1 | 12/2009 | Harada et al. | |
| 2010/0000910 | A1 | 1/2010 | Gallup et al. | |
| 2010/0025184 | A1 | 2/2010 | Shibuya et al. | |
| 2010/0032344 | A1 | 2/2010 | Cross et al. | |
| 2010/0032345 | A1 | 2/2010 | Cross et al. | |
| 2010/0051553 | A1 | 3/2010 | Walterick et al. | |
| 2010/0078358 | A1 | 4/2010 | Tullos et al. | |
| 2010/0099596 | A1 | 4/2010 | Trahan | |
| 2010/0126909 | A1 | 5/2010 | Bhasin et al. | |

OTHER PUBLICATIONS

Ashworth, S. C., "Mercury Removal at Idaho National Engineering and Environmentally Laboratory's New Waste Calciner Facility," *Waste Management*, Feb. 27-Mar. 2, 2000, INEEL, Bechtel BWXT Idaho, LLC, Tucson, AZ, pp. 1-20.

Campanella et al., "Mercury Removal from Petrochemical Wastes," *Water Research*, 1986, vol. 20, No. 1, pp. 63-65.

Carnell et al., "Mercury Matters," *Hydrocarbon Engineering*, Dec. 2005, 4 pages.

Chaiyasit et al., "Decontamination of Mercury Contaminated Steel (API 5L-X52) Using Iodine and Iodide Lixiviant," *Modern Applied Science*, Jan. 2010, vol. 4, No. 1, pp. 12-20.

Clever et al., "The Solubility of Mercury and Some Sparingly Soluble Mercury Salts in Water and Aqueous Electrolyte Solutions," *Journal of Physical and Chemical Reference Data*, 1895, vol. 14, No. 3, pp. 631-680.

Corvini et al., "Mercury Removal from Natural Gas and Liquid Streams," *UOP LLC*, 2002, Houston, TX, pp. 1-9.

Findlay et al., "Removal of Elemental Mercury from Wastewaters Using Polysulfides," *Environmental Science and Technology*, Nov. 1981, vol. 15, No. 11, pp. 1388-1390.

Gildert et al., "Mercury Removal from Liquid Hydrocarbons in Ethylene Plants," *AIChE Paper No. 135c*, Mar. 24, 2010, Spring National Meeting, San Antonio, TX, 14 pages.

Kim et al., "Demulsification of Water-In-Crude Oil Emulsions by a Continuous Electrostatic Dehydrator," *Separation Science and Technology*, 2002, vol. 37, No. 6, pp. 1307-1320.

Larson et al., "Mass-Transfer Model of Mercury Removal from Water via Microemulsion Liquid Membranes," *Industrial & Engineering Chemistry Research*, 1994, vol. 33, No. 6, pp. 1612-1619.

Lemos et al., "Demusification of Water-in-Crude Oil Emulsions Using Ionic Liquids and Microwave Irradiation," *Energy Fuels*, 2010, vol. 24, pp. 4439-4444.

Morel et al., "The Chemical Cycle and Bioaccumulation of Mercury," *Annual Review Ecology, Evolution, and Systematics*, 1998, vol. 29, pp. 543-566.

Núñez et al., "Leaching of Cinnabar with HCI-Thiourea Solutions as the Basis of a Process for Mercury Obtention," *Metallurgical Transactions B*, Sep. 1996, vol. 17B, pp. 443-448.

Sharma et al., "Chemical Demulsification ofNatural Petroleum Emulsions of Assam (India)," *Colloid & Polymer Science*, 1982, vol. 260, pp. 616-622.

Sizeneva et al., "Applied Electrochemistry and Corrosion Protection of Metals: Mercury Passivation Solutions of Potassium Chloride and Sodium Hydroxide and Hypochlorite," *Russian Journal of Applied Chemistry*, 2009, vol. 82, No. 1, pp. 52-56.

Sizeneva et al., "Inorganic Synthesis and Industrial Inorganic Chemistry: A Study of Mercury Dissolution in Aqueous Solutions of Sodium Hypochlorite," *Russian Journal of Applied Chemistry*, 2005, vol. 78, No. 4, pp. 546-548.

Venkatesan et al., "Removal of Complexed Mercury by Dithiocarbamate Grafted on Mesoporous Silica," *Journal of Radioanalytical and Nuclear Chemistry*, 2003, vol. 256, No. 2, pp. 213-218.

Waldo, John H., "Some New Water-Soluble Organo-Mercury Compounds," *Water Soluble Organo Compounds*, Mar. 6, 1931, vol. 53, pp. 992-996.

Wasay et al., "Remediation of a Soil Polluted by Mercury with Acidic Potassium Iodide," *Journal of Hazardous Materials*, 1995, vol. 44, pp. 93-102.

Yuan et al., "Fractions and Leaching Characteristics of Mercury in Coal," *Environmental Monitoring and Assessment*, Jan. 6, 2009, vol. 167, pp. 581-586.

Zhao et al., "Removal of Elemental Mercury by Sodium Chlorite Solution," *Chemical Engineering & Technology*, 2008, vol. 31, No. 3, pp. 350-354.

Pending U.S. Appl. No. 12/109,194, filed Apr. 24, 2008.
Pending U.S. Appl. No. 12/132,475, filed Jun. 3, 2008.
Pending U.S. Appl. No. 12/167,466, filed Jul. 3, 2008.
Pending U.S. Appl. No. 12/883,921, filed Sep. 16, 2010.
Pending U.S. Appl. No. 12/883,971, filed Sep. 16, 2010.
Pending U.S. Appl. No. 12/883,995, filed Sep. 16, 2010.
Pending U.S. Appl. No. 12/950,060, filed Nov. 19, 2010.
Pending U.S. Appl. No. 12/950,170, filed Nov. 19, 2010.
Pending U.S. Appl. No. 12/950,637, filed Nov. 19, 2010.

Larson et al., "Mass-Transfer Model of Mercury Removal from Water via Microemulsion Liquid Membranes," *Industrial & Engineering Chemisty Research*, 1994, vol. 33, No. 6, pp. 1612-1619.

Zhao et al., "Removal of Elemental Mercury by Sodium Chlorite Solution," *Chemical Engineering& Technology*, 2008, vol. 31, No. 3, pp. 350-354.

PCT International Preliminary Report on Patentability, International Application No. PCT/US2011/051033, dated Mar. 19, 2013.

* cited by examiner

PROCESS, METHOD, AND SYSTEM FOR REMOVING HEAVY METALS FROM FLUIDS

CROSS-REFERENCE TO RELATED APPLICATIONS

None.

TECHNICAL FIELD

The invention relates generally to a process, method, and system for removing heavy metals such as mercury and the like from hydrocarbon fluids such as crude oil.

BACKGROUND

Heavy metals such as lead, zinc, mercury, arsenic, silver and the like can be present in trace amounts in all types of fuels such as crude oils. The amount can range from below the analytical detection limit (0.5 μg/kg) to several thousand ppb depending on the feed source. It is desirable to remove the trace elements of these metals from crude oils.

Various methods for removing trace metal contaminants in liquid hydrocarbon feed prior to fractional distillation have been developed. One of the metal contaminants in crude oil is mercury, which is present primarily as elemental dissolved Hg(0) and particulate Hg (liquid droplets or liquid Hg adhering to sand particles). To remove existing Hg particulates or fine HgS and/or HgO crystals precipitated upon treatment of the liquid hydrocarbon, hydrocyclones and/or filters are typically used. Filtering crude oil to remove HgS and/or HgO and other Hg-containing solids is expensive and cumbersome.

In the prior art, iodide impregnated granular activated carbons have been used to remove mercury from water. U.S. Pat. No. 5,336,835 discloses the removal of mercury from liquid hydrocarbon using an adsorbent comprising an activated carbon impregnated with a reactant metal halide, with the halide being selected from the group consisting of I, Br and Cl. U.S. Pat. No. 5,202,301 discloses removing mercury from liquid hydrocarbon with an activated carbon adsorbent impregnated with a composition containing metal halide or other reducing halide. US Patent Publication No. 2010/0051553 discloses the removal of mercury from liquid streams such as non-aqueous liquid hydrocarbonaceous streams upon contact with a Hg-complexing agent for mercury to form insoluble complexes for subsequent removal.

There is still a need for improved methods for trace elements, e.g., mercury, extraction from hydrocarbons such as crude oil, wherein the heavy metals form water soluble metal complexes for subsequent removal from the crude oil by phase separation.

SUMMARY OF THE INVENTION

In one aspect, a method to reduce mercury in a crude oil is provided. The method comprises converting at least a portion of mercury in the crude oil to mercuric iodide in an oil-water emulsion upon contact with an iodine source; and separating the water containing the soluble mercuric iodide from the crude oil for a treated crude oil having a reduced concentration of mercury.

In another aspect, the invention relates to a method to reduce or remove trace elements of heavy metals such as mercury from a crude oil. The method comprises converting at least a portion of mercury in the crude oil to mercuric iodide in an oil-water emulsion upon contact with an iodine source, wherein molecular iodine is generated in-situ in an oxidation-reduction reaction between an iodine species having a charge and a reagent; and separating the water containing the soluble mercuric iodide from the crude oil for a treated crude oil having a reduced concentration of mercury.

In yet another aspect, the molecular iodine is generated in-situ in an oxidation-reduction reaction between an iodine species having a positive charge and a reducing reagent. In this method, a complexing agent is further added to the crude oil to form a water-soluble heavy metal compound, for the water containing the soluble heavy metal compound to be subsequently separated from the crude oil, resulting in a treated crude oil having a reduced concentration of heavy metal.

DETAILED DESCRIPTION

The following terms will be used throughout the specification and will have the following meanings unless otherwise indicated.

As used here, the term "crude oil" refers to natural and synthetic liquid hydrocarbon products including but not limited to petroleum products; intermediate petroleum streams such as residue, naphtha, cracked stock; refined petroleum products including gasoline, other fuels, and solvents. The liquid hydrocarbon products can be directly from oil wells or after the products have been further processed or derived. The term "petroleum products" refer to crude oil, solid, and semi-solid hydrocarbon products including but not limited to tar sand, bitumen, etc. The term "petroleum products" also refer to petroleum products derived from coal.

As used herein, the term "heavy metals" refer to gold, silver, mercury, platinum, palladium, iridium, rhodium, osmium, ruthenium, arsenic, and uranium.

As used herein, the term "trace element" refers to the amount of heavy metals to be removed from the crude oil, or for the concentration to be significantly reduced. The amount of trace element varies depending on the crude oil source and the type of heavy metal, for example, ranging from a few ppb to up to 30,000 ppb for mercury.

As used herein, mercury sulfide may be used interchangeably with HgS, referring to mercurous sulfide, mercuric sulfide, or mixtures thereof. Normally, mercury sulfide is present as mercuric sulfide with a stoichiometric equivalent of one mole of sulfide ion per mole of mercury ion.

As used herein, the term "mercury salt" or "mercury complex" meaning a chemical compound formed by replacing all or part of hydrogen ions of an acid with one or more mercury ions.

The term "oil-water" as used herein means any mixture containing a crude oil with water, inclusive of both oil-in-water emulsions and water-in-oil emulsions. In one embodiment, the emulsion particles are of droplet sizes. In another embodiment, the emulsion particles are of micron or nano particle sizes. In one embodiment, oil is present as fine droplets contained in water in the form of an emulsion, i.e., emulsified hydrocarbons, or in the form of undissolved, yet non-emulsified hydrocarbons.

The term "interphase" or "interphase layer" or "interface layer" or "emulsion layer" may be used interchangeably, referring to the layer in between the oil and water phases, having characteristics and properties different from the oil and water phases. In one embodiment, the interface layer is a cloudy layer in between the water and oil phases. In another embodiment, the interface layer comprises a plurality of aggregates of coalescence (or droplets), with the aggregates being randomly dispersed in either the water phase or the oil phase.

"Complexing agent" or "chelating agent" refers to a compound that is capable of reacting with another chemical group, e.g., mercury compounds, to form a covalent bond, i.e. is covalently reactive under suitable reaction conditions.

Crudes and crude blends are used interchangeably and each is intended to include both a single crude and blends of crudes. The invention effectively decreases the levels of heavy metals such as mercury, lead, zinc, etc. from crude oil.

Crudes may contain small amounts of heavy metals such as mercury, which may be present as elemental mercury $Hg^o$, ionic Hg, inorganic mercury compounds or organic mercury compounds. In one embodiment, the mercury in crude oil is converted into a water soluble form that would partition into the aqueous phase for subsequent separation and convenient disposal by methods including but not limited to re-injection, or disposed back into the reservoir. In one embodiment, the mercury is converted into soluble by-products upon reaction with iodine, metallic mercury ($Hg^o$) being converted into mercury ions ($Hg^{2+}$), subsequently forming aqueous soluble $Hg^{2+}$ complexes.

Trace Element Removal with Iodine: In one embodiment, the crude oil is first brought into contact with iodine, or a compound containing iodine such as alkali metal salts of iodine, e.g., halides or iodide of a cation. In one embodiment, the iodide is selected from ammonium iodide, alkali metal iodide, an alkaline earth metal iodide, and etheylenediamine dihydroiodide.

In one embodiment, the amount of the iodine is chosen to result in an atomic ratio of iodine to mercury of at least 1:1. In a second embodiment, a ratio ranging from 1.5:1 to 6:1. In a third embodiment, a ratio of 2:1 to 4:1. In one embodiment, the crude oil is brought into contact with solid iodine. In another embodiment, an iodine solution in petroleum distillate is injected into the liquid hydrocarbon, e.g., gas condensate or crude oil. Upon contact with the crude oil, iodine reacts with elemental Hg droplets, elemental Hg adsorbed on formation minerals, elemental Hg dissolved in the crude oil, as well as mercury compounds including but not limited to HgS, HgSe, and HgO. In the reactions, $Hg^o$ is oxidized to $Hg^{2+}$, and $I_2$ is reduced to $2I^-$. In one embodiment, a slight excess of iodine is employed to prevent the formation of water insoluble $Hg_2I_2$. Mercuric iodide is highly soluble in water and not very soluble in hydrocarbons.

$$Hg^o(\text{solution})+I_2(\text{solution})=HgI_2(\text{solution})\rightarrow Hg^{2+}(\text{aq})+2I^-(\text{aq})$$

$$HgI_2(\text{solution})+Hg^o(\text{liquid})=Hg_2I_2(\text{solid})$$

$$Hg_2I_2(\text{solid})+I_2(\text{solution})=2HgI_2(\text{solution})\rightarrow 2Hg^{2+}(\text{aq})+4I^-(\text{aq}).$$

With respect to solids such as HgS, the solids are dissolved by $I_2$, wherein $I_2$ oxidizes the solids to form $Hg^{2+}$ and elemental S or $SO_4^{2-}$. The reactions proceed very fast at room temperature (e.g., 25° C.), and even faster at elevated temperatures.

Trace Element Removal with In-situ Iodine Formation: Elemental iodine is a rather expensive reagent. Elemental iodine is in the form of crystals, which sublime readily to generate a violet colored vapor. Other chemicals are often used to combine in some form with elemental iodine to provide stable preparations. In one embodiment, instead of using molecular iodine $I_2$, a reagent is used which reacts with at least an iodide salt to covert iodine anion ($I^-$) to molecular iodine ($I_2$) in an oxidation-reduction reaction, allowing for the economical in-situ generation of $I_2$.

In the oxidation-reduction reaction, the crude oil is brought into contact with an oxidizing agent and a negatively charged iodine, or the crude oil can be brought into contact with a reducing agent plus a positively charged iodine.

In one embodiment, molecular iodine is formed by reducing an iodine species with a positive oxidation state (a positively charged iodine) or oxidizing a negatively charged iodine (iodine anion $I^-$). In another embodiment, an oxidant and reducing agent which both contain iodine can be used to form molecular iodine. Reagents with lower oxidation potentials can be used to reduce the iodine species to molecular iodine. Reagents with a higher oxidation potential than iodide can oxidize iodide into molecular iodine.

Iodine species exist in different oxidation states. The positive oxidation states are usually found in inorganic species such as acids, salts, oxides, or halides. Examples of iodide salts include but are not limited to iodides selected from the group of ammonium, alkali metal, and alkaline earth metal. The negative oxidation states appear in iodine species that are in the form of iodide salts or organic iodo-compounds.

Examples of iodine species with a positive oxidation state that can be used to generate molecular iodine in-situ include but are not limited to: periodic acid ($H_5IO_6$), potassium periodate ($KIO_4$), sodium periodate ($NaIO_4$) all with oxidation state of +7; iodic acid ($HIO_3$), potassium iodate ($KIO_3$), potassium hydrogen iodate ($KHI_2O_6$), sodium iodate ($NaIO_3$), iodine oxide ($I_2O_5$), all with oxidation state of +5; iodine trichloride ($ICl_3$) with oxidation state of +3; iodine monobromide (IBr), iodine monochloride (ICl) all with oxidation state of +1.

Iodine compounds with negative oxidation state (−1) include but are not limited to hydriodic acid (HI), sodium iodide (NaI), potassium iodide (KI), ammonium iodide ($NH_4I$), aluminum iodide ($AlI_3$), boron triodide ($BI_3$), calcium iodide ($CaI_2$), magnesium iodide ($MgI_2$), iodoform ($CHI_3$), tetraiodoethylene ($C_2I_4$), iodoethanol, iodoacetic anhydride, iododecane, and iodobenzene.

In one embodiment, a reagent that is an iodine reductant is used to react with an iodine species having a positive oxidation state to generate molecular iodine in-situ. Examples of reagents that function as iodine reductants include but are not limited to thioureas, thiols, ascorbates, imidazoles, and thiosulfates such as sodium thiosulfate.

In another embodiment, a reagent that is an iodine oxidant is employed to react with a source of iodine anion to generate molecular iodine in-situ. The excess negatively charged iodide function as complexing agents, moving mercury compounds from the oil phase and/or the interphase to the water phase for subsequent removal. Examples of oxidizing reagents that can be used to generate iodine in-situ include but are not limited to sources of peroxide (including hydrogen peroxide, urea peroxide, peroxy acids, alkylperoxides, etc.), bromine ($Br_2$), ozone ($O_3$), cumene hydroperoxide, t-butyl hydroperoxide, NaOCl, iodate (such as potassium iodate $KIO_3$ and sodium iodate $NaIO_3$), monopersulfate, percarbonate, perchlorate, permanganate, perphosphate, and peroxidases that are capable of oxidizing iodide. The reaction can be at atmospheric pressure and ambient temperature.

$$H_2O_2+2H^++2I^-\rightarrow I_2(\text{solution})+2H_2O;$$

$$O_3(g)+2H^+2I^-\rightarrow O_2(g)+I_2(\text{solution})+H_2O;$$

$$OCl^-+H_2O+2I^-I\rightarrow I_2(\text{solution})+Cl^-+2OH^-.$$

In one embodiment, once in-situ iodine is produced, the iodine will convert $Hg^o$ into mercury ions $Hg^2$, with excess $I^-$ from the iodide salt forming water soluble Hg—I complexes. The ratio of molecular iodine generated in-situ with starting iodine materials ranges between 0.5-1 in one embodiment. In a second embodiment, the ratio ranges from 0.65 to 1. In a third embodiment, from 0.8 to 1. In a fifth embodiment, from 0.95 to 1. In one embodiment, the higher the ratio of molecular iodine to total iodine, the higher the removal of trace elements from the crude oil.

In one embodiment, the rate of iodine generation is quite rapid with at least 50% of the equilibrium concentration of the molecular iodine being generated within the first 10 minutes of contact between the starting reagents.

With respect to the amount of required iodine (whether generated in-situ or elemental iodine), in one embodiment, the molar ratio of iodine to heavy metals such as mercury ranges from at least 1:1 to 30,000:1 in one embodiment; from 2:1 to 1,000:1 in a second embodiment; from 5:1 to 100:1 in a third embodiment; greater than 3:1 in a fourth embodiment, and less than 10,000:1 in a fifth embodiment. In a sixth embodiment, the amount is sufficient to form water soluble $Hg^2$ complexes in the system.

Addition of a Complexing Agent to Reduction Agent: In one embodiment wherein iodine is generated in-situ with positively charged iodine containing species such as $KIO_4$, $ICl_3$, etc., a complexing agent is also added to the crude oil to extract the mercury cations from the oil phase and/or the interphase to the water phase. In one embodiment, the complexing agent essentially forms a soluble mercury compound, i.e., mercury complexes, when contacting the mercury cations.

In one embodiment, a complexing agent having a large equilibrium binding constant for non-complexed mercury ions is selected. Examples include thiol groups, dithiocarbamic acid, thiocarbamic acid, thiocarbazone, cryptate, thiophene groups, thioether groups, thiazole groups, thalocyanine groups, thiourenium groups, amino groups, polyethylene imine groups, hydrazido groups, N-thiocarbamoyl-polyalkylene polyamino groups, derivatives thereof, and mixtures thereof. Other examples of complexing agents include but are not limited to hydrazines, sodium metabisulfite ($Na_2S_2O_5$), sodium thiosulfate ($Na_2S_2O_3$), thiourea, the group of sulfides, ammonium thiosulfate, alkali metal thiosulfates, alkaline earth metal thiosulfates, iron thiosulfates, alkali metal dithionites, alkaline earth metal dithionites, and mixtures thereof. Examples of sulfides include but are not limited to potassium sulfide, alkaline earth metal sulfides, sulfides of transition elements number 25-30, aluminum sulfides, cadmium sulfides, antimony sulfides, Group IV sulfides, and mixtures thereof.

In another embodiment, the inorganic sulfur complexing agents are oxygen-containing compounds such as thiosulfates and dithionites. Examples include alkali metal thiosulfates, alkaline earth metal thiosulfates, iron thiosulfates, alkali metal dithionites, and alkaline earth metal dithionites and mixtures thereof. Suitable alkali metal thiosulfates include ammonium thiosulfate, sodium thiosulfate, potassium thiosulfate, and lithium thiosulfate. Examples of alkaline earth metal thiosulfates include calcium thiosulfate and magnesium thiosulfate. Ferric thiosulfate exemplifies an iron thiosulfate which may be employed. Alkali metal dithionites include sodium dithionite and potassium dithionite. Calcium dithionite is suitable as an alkaline earth metal dithionite complexing agent.

In another embodiment, the complexing agent is a polyamine for forming stable cationic complexes with the ions of heavy metals. Exemplary polyamines include ethylenediamine (EDA), propylenediamine, triaminotriethylamine, diethylenetriamine, triethylenetetramine (TRIEN), tetraethylenepentamine and tetra-2-aminoethylethlenediamine. In one embodiment, the polyamine may include carboxyl groups, hydroxyl groups and/other substituents, as long as they do not weaken the complex formed with polyamine. In one embodiment, the complexing agent is tetraethylenepentamine (TETREN), which forms a stable complex with mercury at a pH around 4.

In one embodiment, the complexing agent is selected from the group of DEDCA (diethyl dithiocarbamic acid) in a concentration of 0.1 to 0.5M, DMPS (sodium 2,3-dimercaptopropane-1-sulfonate), DMSA (meso-2,3-dimercaptosuccinic acid), EDTA (ethylene-diamine-tetra-acetic acid), DMSA (Dimercaptosuccinic acid), BAL (2,3-dimercaptopropanol), CDTA (1,2-cyclohexylene-dinitrilo-tetraacetic acid), DTPA (diethylene triamine pentaacetic acid), NAC (N-acetyl L-cystiene), sodium 4,5-dihydroxybenzene-1,3-disulfonate, polyaspartates; hydroxyaminocarboxylic acid (HACA); hydroxyethyliminodiacetic (HEIDA); iminodisuccinic acid (IDS); nitrilotriacetic acid (NTA), sodium gluconate, and other carboxylic acids and their salt forms, phosphonates, acrylates, and acrylamides, and mixtures thereof.

The complexing agents are employed in a sufficient amount to effectively stabilize (forming complexes with) the soluble heavy metals in the oil-water mixture. In one embodiment, the molar ratio of complexing agent to soluble mercury in the mixture ranges from 1:1 to about 5,000:1. In a second embodiment from 2:1 to about 3,000:1. In a third embodiment from 5:1 to about 1,000:1. In a fourth embodiment, from 20:1 to 500:1. In a fifth embodiment, the amount is sufficient to form water soluble $Hg^2$ complexes in the system.

Method for Removing/Decreasing Levels of Heavy Metals in Crude Oil: As iodine is soluble in crude oil, in one embodiment, iodine is introduced into the crude oil as a solid, with the crude oil being routed through a column or bed containing solid iodine provided as tablets, in granular form, or as finely divided iodine. In another embodiment, iodine is added to the crude oil as a solution in solvents such as methanol, naphtha, diesel, gasoline, mercury-free crude oil, solvents, and the like. In a third embodiment, iodine may be introduced into the crude oil as a gas with the iodine-containing gas stream being sparged into a pipeline or vessel containing crude oil at various intervals, using means known in the art. The iodine-containing gas stream may be formed by providing a solid iodine source and contacting the solid iodine with an inert gas stream, e.g., helium, nitrogen, argon, and air. The solid iodine source may be finely divided iodine. The gas stream is provided at a pre-determined temperature selected to vaporize the solid iodine at a pre-selected rate.

In one embodiment wherein $I_2$ is generated in-situ, an oxidizing agent is first prepared or obtained. The oxidizing agent can be prepared in an aqueous form. In yet another embodiment, an organic oxidizing agent is used. The oxidant is brought in contact with the crude oil containing heavy metals, e.g., trace elements of mercury and the like, by means known in the art and in a sufficient (or effective amount) for to convert at least a portion of, e.g., at least 50%, of the heavy metals into cations. In one embodiment, a sufficient amount is added for at least 80% conversion. In another embodiment, at least 95% conversion.

In the next step, a reagent containing iodine species is prepared/provided for the generation of iodine in-situ, and subsequently, for the reaction of iodine and mercury to form water soluble complexes. In yet another embodiment with the use of a reductant containing iodine species, a complexing agent is further added to extract cationic mercury from the oil phase/interphase into the water phase.

In yet other embodiments wherein $I_2$ is generated in-situ, an iodine column is first prepared by adsorbing the iodine species, e.g., $KI_3$, to a strong anion exchanger, e.g., containing tertiary amine groups. In the next step, iodine is released from the column, i.e., being reduced to iodide, upon contact with a solid adsorbent containing the reagent that would function as the reductant/oxidant. In one embodiment, a thiol-containing adsorbent is used for the reducing step, releasing free iodine (as generated in-situ).

The feeding of the iodine containing compound and/or reductant and/or oxidant and/or complexing agents can be separate, or together as one composition. In one embodiment for in-situ iodine generation, the oxidant and complexing agent containing iodine species are first combined, then brought into contact with the crude oil. In another embodiment, the iodine containing species is first brought into contact with the crude oil, followed by the addition of the oxidant. In yet another embodiment, the oxidant is first mixed with the crude oil, then followed by the addition of a complexing agent containing iodine species. In a fourth embodiment, crude oil is first brought into contact with an oxidizing agent and negatively charged iodine reagent, followed by the addition of a complexing agent to extract the cationic mercury into the water phase.

The amount of reagents, i.e., oxidant, reductant, or iodine containing species should be sufficient to convert the heavy metals in the crude oil into heavy metal cations, and subsequently, into water soluble heavy metal complexes. In one embodiment, the added reagents make up from 0.5 to 50 volume percent of the total mixture (of crude oil and reagents).

In a second embodiment, the added reagents make up less than 40 vol. % of the mixture. In a third embodiment, less than 30 vol. %. In a fourth embodiment, less than 10 vol. % percent. In a fifth embodiment, less than 5 vol. %.

In one embodiment, mercury removal can be enhanced at a low pH concentration with the addition of an acid, e.g., acidic potassium iodide solution with a mixture of KI and HCl, for a pH of 5 or less in one embodiment, and 2 or less in another embodiment. In yet another, the reagent is an acidic thiourea, with an acid concentration of up to 5M and thioureas concentration from 0.3 to 1.5M.

In one embodiment, liquid reagents is introduced by utilizing high mechanical shearing such as those produced by forcing the liquid, under pressure, through fine hole nozzles or by utilizing dual fluid nozzles where the iodine generating reagent is atomized by a compressed fluid (e.g., air, steam or other gas). When the components selected in making the iodine in-situ is available as solids, they can be ground separately or in combination, if suitable, to a fine powder and injected/blown into a gas stream at appropriate temperatures for introduction into the crude oil. Liquid reagent component(s) can also be mixed with powder reagent components for introduction into the crude oil.

The rate of in-situ iodine generation is rapid with at least 75% of the equilibrium concentration of molecular iodine being generated within the first 10 minute of contact between the specific iodine generating chemical agents and the crude oil. In a second embodiment, the at least 75% rate is achieved within the first 5 minutes. In a third embodiment, at least 90% rate is achieved within the first 10 minutes.

The composition(s) can be introduced or fed continuously or intermittently, i.e., batch-wise, into operating gas or fluid pipelines, for example. Some of the reagents can be fed continuously, while other compositions can be fed intermittently. Alternatively, batch introduction is effective for offline pipelines.

The contact can be at any temperature that is sufficiently high enough for the crude oil to be completely liquid. In one embodiment, the contact is at room temperature. In another embodiment, the contact is at a sufficiently elevated temperature, e.g., at least 50° C. In one embodiment, the contact time is at least a minute. In another embodiment, the contact time is at least 5 minutes. In a third embodiment, at least 1 hr. In a fourth embodiment, the contact is continuous for at least 2 hrs.

In one embodiment, the iodine is introduced into the crude oil for a final concentration of 25-100 ppm. In yet another embodiment, iodine is added to the crude oil as a mixture with a complexing agent reagent such as potassium iodide KI in concentrations of 5 wt. % KI, 10 wt. % KI, 20 wt. % KI, or 40 wt. % KI (mixtures also known as Lugol's Solution). Concentration of $I_2$ added can be controlled by means known in the art, including mass or volume flow controllers, online analyzers, ORP (redox potential) and iodine ion specific detection instruments. Potassium iodide combines with mercuric iodide to form a water soluble compound $K_2HgI_4$. Besides potassium iodide, other water soluble halide having the formula RX or $RX_2$ can also be used as complexing agents, with R being selected from the group consisting of potassium, lithium, sodium, calcium, magnesium, and ammonium and X is iodide, bromide or chloride. In one embodiment, an aqueous solution containing sodium iodide and sodium iodate is employed to essentially convert 100% of the iodide to molecular iodine.

Once water soluble heavy metal complexes are formed (and extracted from the emulsion), the water phase containing the heavy metal complexes can be separated from the crude oil in a phase separation device known in the art, e.g., a cyclone device, electrostatic coalescent device, gravitational oil-water separator, centrifugal separator, etc., resulting in a treated crude oil with a significantly reduced level of heavy metals. The heavy metal complexes can be isolated/extracted out of the effluent and subsequently disposed. In one embodiment, mercury is electrochemically removed from the aqueous extractant to regenerate a mercury-free aqueous extractant composition.

The mercury removal in one embodiment is done in the field, i.e., close to or at the upstream wellhead, for better quality crude to sell to the refinery. After crude oil is removed from a well, the crude can be treated in a facility at the wellhead or on an off-shore platform, or right in the pipeline used to transport the crude to ports or refineries. The mixing of crude oil with the iodine source, and other materials such as oxidizing agents, in one embodiment is achieved with motion by pump stations along the pipeline. In another embodiment, the mercury removal is a process integrated with the refinery and downstream from the wellhead.

Depending on the source, the crude oil feed has an initial mercury level of at least 50 ppb. In one embodiment, the initial level is at least 5,000 ppb. Some crude oil feed may contain from about 2,000 to about 100,000 ppb mercury. In one embodiment with mercury as the heavy metal for trace element removal or reduction, the mercury level in the crude oil after iodine treatment is reduced to 100 ppb or less. In another embodiment, the level is brought down to 50 ppb or less. In a third embodiment, the level is 20 ppb or less. In a fourth embodiment, the level is 10 ppb or less. In a fifth embodiment, the level is 5 ppb or less. In yet another embodiment, the removal or reduction is at least 50% from the original level of heavy metals such as mercury or arsenic. In a fifth embodiment, at least 75% of a heavy metal such as mercury is removed. In a seventh embodiment, the removal or the reduction is at least 90%.

Mercury level can be measured by conventional techniques known in the art, including but not limited to cold vapor atomic absorption spectroscopy (CV-AAS), cold vapor atomic fluorescence spectroscopy (CV-AFS), gas chromatography combined with inductively coupled plasma mass spectrometry (or GC-ICP-MS with 0.1 ppb detection limit), and combustion amalgamation, etc.

It should be further noted that the embodiments described herein can also be used for the removal of and reduction of other heavy metals from crude oil, including but not limited to lead, zinc, mercury, silver, arsenic and the like. It should be further noted that $I_2$ is corrosive, thus its use requires precaution with appropriate materials. Equipment for use in containing and/or handling $I_2$ such as storage containers, pumps, injection quills in one embodiment is made of, or coated with materials such as Teflon, polyvinyl chloride (PVC), polyvinylidene fluoride (PVDF), high nickel alloys, and the like. As $I_2$ is introduced or mixed into the crude oil at a fairly low concentration, e.g., 25-200 ppm for example, normal carbon steel typically used for equipment containing crude oil is sufficient and not affected by the corrosivity inherent with $I_2$. Additionally, as $I_2$ oxidation of heavy metals occurs and $I_2$ is reduced to $I^-$. Corrosion due to iodide is also less of an issue, particularly when complexing agents such as thiosulfate and the like are further added to the crude oil mixture.

EXAMPLES

The following examples are given to illustrate the present invention. It should be understood, however, that the invention is not to be limited to the specific conditions or details described in these examples. In examples calling for mercury vapor feed, a sufficient amount of mercury (e.g., one or two drops of elemental mercury in a bottle) was sparged by using nitrogen ($N_2$) gas into another bottle containing white mineral oil overnight.

Example 1

50 mL of mercury vapor feed preparation containing approximately 1,100 ppb Hg was added to a number of 100 mL glass tubes, then mercury level was measured using LUMEX mercury analyzer equipped with PYRO-915+. 50 mL of distilled water was placed in the tubes, and the mercury level was measured using LUMEX mercury analyzer equipped with PYRO-915+. A pre-determined volume of 3 different oxidants (hydrogen peroxide ($H_2O_2$), t-butyl hydroperoxide, and cumene hydroperoxide) was added to each reactor for a final oxidant concentration of 50 ppm. The oil-water mixture was stirred up for 1 minute. In the next step, different complexing reagents (potassium iodide (KI), sodium thiosulfate ($Na_2S_2O_3$), TETREN, and $Na_4EDTA$) were added to each reactor to make a final concentration of: 50, 500 and 5,000 ppm KI; 470 and 4,700 ppm $Na_2S_2O_3$; 570 and 5,700 ppm TETREN; 1,200 and 12,000 ppm $Na_4EDTA$. The tubes were shaken vigorously for 1 minute. Aliquots of both oil and water from each were analyzed for mercury. Results are presented in Table 1 showing the % of mercury removal for each combination of oxidants and reagents.

TABLE 1

| | KI (in ppm) | | | $Na_2S_2O_3$ | | TETREN | | EDTA | |
|---|---|---|---|---|---|---|---|---|---|
| Oxidant | 5,000 | 500 | 50 | 4,700 | 470 | 5,700 | 570 | 1,200 | 12,000 |
| 50 ppm $H_2O_2$ | 99% | 88% | 30% | — | 24% | 17% | 19% | — | 2% |
| 50 ppm tBHP* | 40% | 11% | — | 10% | — | 16% | 14% | 15% | 12% |
| 50 ppm CHP** | 35% | — | — | 16% | — | — | — | — | — |

*tBHP: t-butyl hydroperoxide
**CHP: cumene hydroperoxide

Example 2

50 mL of distilled water was placed in each of a number of 250 mL glass tubes, and the mercury level was measured using LUMEX mercury analyzer equipped with PYRO-915+. 50 mL of mercury vapor feed preparation containing approximately 400 ppb Hg was added to each of the glass tubes, then mercury level was measured using LUMEX mercury analyzer equipped with PYRO-915+. A pre-determined volume of hydrogen peroxide (0.3% $H_2O_2$) stock solution was added to each of the tubes at molar ratio of $H_2O_2$ to Hg of 246:1. The mixture was stirred up for 1 minute at 600 rpm. In the next step, different complexing reagents (potassium iodide (KI), sodium thiosulfate ($Na_2S_2O_3$), TETREN, and $Na_4EDTA$) were added to each tube at a molar ratio of complexing agent to mercury as 5,000:1. The tubes were agitated at 600 rpm. Aliquots of both oil and water from each tube at 2, 5, 10, 15, and 30 minute intervals and analyzed for mercury.

Although not included here, the methods described herein can also be employed to remove or reduce levels of heavy metals other than mercury from crude oil, including but not limited to lead, zinc, mercury, arsenic, silver and the like. For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A method for treating a crude oil to reduce its mercury level, comprising:

providing a crude oil containing an oil-water emulsion;

converting at least a portion of mercury in the crude oil to water soluble mercuric iodide in the oil-water emulsion upon contact with a molecular iodine; and separating the oil-water emulsion to obtain a water phase containing the water soluble mercuric iodide and a treated crude oil having a reduced concentration of mercury, wherein the treated crude oil contains less than 10 ppb mercury.

2. The method of claim 1, wherein the crude oil is brought into contact with molecular iodine by routing the crude oil through a bed containing solid iodine.

3. The method of claim 1, wherein the crude oil is brought into contact with the molecular iodine by mixing the crude oil with a solution containing iodine in a solvent selected from methanol, naphtha, diesel, gasoline, mercury-free crude oil, and mixtures thereof.

4. The method of claim 1, wherein the contact is carried out in a pipeline for transporting crude oil, and wherein molecular iodine is continuously or intermittently fed into the pipeline.

5. The method of claim 1, wherein the contact is carried out in a vessel containing crude oil.

6. The method of claim 1, wherein the crude oil is brought into contact with molecular iodine by sparging an iodine-containing gas stream into the crude oil.

7. The method of claim 6, wherein the iodine-containing gas stream is formed by contacting a solid iodine source with a gas stream.

8. The method of claim 1, wherein molecular iodine is generated in-situ in solution in an oxidation-reduction reaction between an iodine species having a charge and a reagent which functions as a reductant or an oxidant depending on the charge of the iodine species.

9. The method of claim 8, wherein the iodine species is positively charged, and the reagent functions as a reductant.

10. The method of claim 8, wherein the iodine species is negatively charged, and the reagent functions as an oxidant.

11. The method of claim 9, wherein the positively charged iodine species is selected from the group of periodic acid ($H_5IO_6$), potassium periodate ($KIO_4$), sodium periodate ($NaIO_4$), iodic acid ($HIO_3$), potassium iodate ($KIO_3$), potassium hydrogen iodate ($KHI_2O_6$), sodium iodate ($NaIO_3$), iodine oxide ($I_2O_5$), iodine trichloride ($ICl_3$), iodine monobromide (IBr), and iodine monochloride (ICl).

12. The method of claim 10, wherein the negatively charged iodine species is selected from the group of hydriodic acid (HI), sodium iodide (NaI), potassium iodide (KI), ammonium iodide ($NH_4I$), aluminum iodide ($AlI_3$), boron triodide ($BI_3$), calcium iodide ($CaI_2$), magnesium iodide ($MgI_2$), iodoform ($CHI_3$), tetraiodoethylene ($C_2I_4$), iodoethanol, iodoacetic anhydride ($(ICH_2CO)_2O$), iododecane ($CH_3(CH_2)_3I$), and iodobenzene.

13. The method of claim 9, wherein the reductant is selected from the group of thioureas, thiols, thiosulfates, ascorbates, imidazoles, and mixtures thereof.

14. The method of claim 10, wherein the oxidant is selected from the group of peroxides, ozone (O3), iodates, bromine (Br2), monopersulfates, perborate, percarbonate, perchlorate, perphosphate, permanganate, alkali metal salts of peroxide, alkaline earth metal salts of peroxide, peroxidases, and mixtures thereof.

15. The method of claim 1, wherein molecular iodine is present in a molar ratio of molecular iodine to mercury in the crude oil ranges from 1:1 to 30,000:1.

16. The method of claim 1, wherein molecular iodine is present in a molar ratio of molecular iodine to mercury in the crude oil ranges from 2:1 to 10,000:1.

17. A method for treating a crude oil to reduce its mercury level, comprising:

providing a crude oil containing a water phase;

converting at least a portion of mercury in the crude oil to water soluble mercuric iodide in the water phase upon contact with molecular iodine in a solvent; and separating the water phase containing the water soluble mercuric iodide from the crude oil in a phase separation device for a treated crude oil having less than 10 ppb mercury.

18. The method of claim 17, wherein the solvent is selected from the group of methanol, diesel, naphtha, gasoline, mercury-free crude oil, and mixtures thereof.

* * * * *